US005399196A

United States Patent [19]

Ichikawa et al.

[11] Patent Number: 5,399,196

[45] Date of Patent: Mar. 21, 1995

[54] DIE COATER

[75] Inventors: Kunihiko Ichikawa, Machida; Takefumi Yoshikawa, Kodaira, both of Japan

[73] Assignee: Mitsubishi Kasei Corporation, Tokyo, Japan

[21] Appl. No.: 99,129

[22] Filed: Jul. 29, 1993

[30] Foreign Application Priority Data

Jul. 31, 1992 [JP] Japan ..... 4-224595

[51] Int. Cl.[6] ..... B05C 3/02

[52] U.S. Cl. ..... 118/407; 118/410; 118/419; 239/583; 239/61; 239/124

[58] Field of Search ..... 239/61, 124, 125, 127, 239/583, 598; 118/400, 407, 419, 420, 123, 125, 200, 257, 300, 325, 440

[56] References Cited

U.S. PATENT DOCUMENTS

| | | | |
|---|---|---|---|
| 2,577,457 | 12/1951 | Freeman | 239/61 X |
| 2,681,294 | 6/1954 | Beguin | 118/407 X |
| 2,793,079 | 5/1957 | Haye | 239/124 |
| 2,975,754 | 3/1961 | Wright | 118/407 |
| 3,529,626 | 9/1970 | German | 239/124 |
| 3,801,013 | 4/1974 | Renaud | 239/61 |
| 3,832,120 | 8/1974 | Shaffer | 425/466 |
| 3,865,308 | 2/1975 | Pringle et al. | 239/61 |
| 3,870,233 | 3/1975 | Wilhelm et al. | 239/15 |
| 4,081,141 | 3/1978 | Courson et al. | 239/551 |
| 4,106,699 | 8/1978 | Holt | 239/124 |
| 4,387,851 | 6/1983 | Dick | 239/135 |
| 4,497,341 | 2/1985 | Wright | 137/563 |
| 4,717,603 | 1/1988 | Chino et al. | 427/434.3 |
| 4,722,482 | 2/1988 | Jordan et al. | 239/585 |
| 4,846,226 | 7/1989 | Merritt | 137/871 |
| 4,854,339 | 8/1989 | Hoeptner | 137/282 |
| 4,875,625 | 10/1989 | Jones | 239/124 |
| 5,136,972 | 8/1992 | Naka et al. | 118/410 |

FOREIGN PATENT DOCUMENTS

| | | |
|---|---|---|
| 2-38022 | 2/1990 | Japan . |
| 2-214569 | 8/1990 | Japan . |
| 4038621 | 2/1991 | Japan . |
| 1503511 | 4/1974 | United Kingdom . |
| 2092512 | 8/1982 | United Kingdom . |

*Primary Examiner*—James C. Housel
*Assistant Examiner*—Harold Y. Pyon
*Attorney, Agent, or Firm*—Oblon, Spivak, McClelland, Maier & Neustadt

[57] ABSTRACT

A die coater comprising a die composed of upper and lower mold-pieces which form a manifold and a slit extending from the manifold, a first paint supply pipe communicating with one end portion of the manifold, a second paint supply pipe communicating with another end portion of the manifold and a flow channel closing member disposed in the manifold in a fluid sealing state, the member being movable along the manifold.

6 Claims, 3 Drawing Sheets (14a) → OPEN (14b) → CLOSE (17a) → OPEN → CLOSE (17b) → OPEN → CLOSE (14a),(14b) = CLOSE (17a),(17b) = CLOSE (14b) → OPEN (14a) → OPEN
(14b) → CLOSE
(17a) → OPEN → CLOSE
(17b) → OPEN → CLOSE

DIE COATER

BACKGROUND OF THE INVENTION

The present invention relates to a die coater and, particularly, to an improved die coater capable of changing paints from one to another efficiently and easily.

A die coater has a die having upper and lower mold-pieces which form a manifold and a slit extending from the manifold. The die coater is used for coating the surface of a sheet material under running. For example, Japanese Patent Application Laid-Open (KOKAI) Nos. 2-38022(1990) and 2-214569 (1990) are referred to.

When color change is conducted by changing paints from one to another in a conventional die coater, it is necessary to stop the supply of the paint and clean the inside of a manifold, slit or the like by using a solvent, but such a cleaning operation usually requires to disassemble the die and, thus, it needs much time.

For solving the foregoing problem, the present inventors have made earnest studies and, as a result, have found that by disposing paint supply pipes which communicate with both end portions of a manifold and disposing a flow channel closing member in the manifold in a fluid sealing state, the member being movable along the manifold, paints can be changed from one to another efficiently and easily without disassembling the die for the cleaning operation when the paint is changed. The present invention has been accomplished based on the finding.

SUMMARY OF THE INVENTION

In an aspect of the present invention, it is provided a die coater comprising a die composed of upper and lower mold-pieces which form a manifold and a slit extending from the manifold, a first paint supply pipe communicating with one end portion of the manifold, a second paint supply pipe communicating with another end portion of the manifold, and a flow channel closing member disposed in the manifold in a fluid sealing state, the member being movable along the manifold.

DETAILED DESCRIPTION OF THE INVENTION

Figure 1:
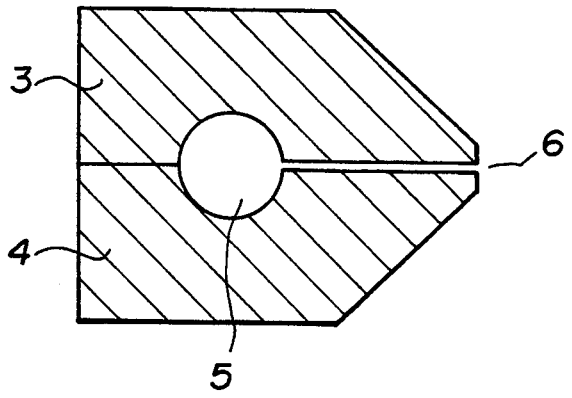
FIG. 1 is a schematical cross-sectional view of a die.

A die used in the die coater according to the present invention is basically similar to a known die and the die is constituted by upper and lower mold-pieces (3, 4) which form a manifold (5) and a slit (6) extending from the manifold. The mold-pieces are usually disposed between right and left side plates (1, 2). Both end portions of the manifold (5) are usually formed by the side plates (1, 2) which are properly shaped, respectively.

Paint supply pipes (**7*a*, 7*b*) communicate with both end portions of the manifold (5) and are usually disposed to the side plates (1, 2), respectively. Paint supply pumps (8*a*, 8*b*) are connected to the paint supply pipes (7*a*, 7*b*), respectively. Preferably, joints (9*a*, 9*b*) are respectively disposed to the midway of the paint supply pipes (7*a*, 7*b*) so that the paint supply pumps (8*a*, 8*b***) are detachable from the die.

Paints in paint reservoirs (**10*a*, 10*b*) are respectively sucked by way of paint sucking pipes (21*a*, 21*b*) by the paint supply pumps (8*a*, 8*b*) and supplied through the paint supply pipes (7*a*, 7*b*) into the manifold (5). Then, one of the paints is distributed in the manifold (5) and extruded as a thin film from the slit (6**).

Preferably, the side plates (1, 2) have recycling pipes (**11*a*, 11*b*) each communicating with the manifold (5), and branched pipes (12*a*, 12*b*) leading to liquid waste reservoirs (13*a*, 13*b*) are disposed to the recycling pipes (11*a*, 11*b*), respectively. Valves (14*a*, 14*b* and 15*a*, 15*b*) are disposed to the recycling pipes (11*a*, 11*b*) and the branched pipes (12*a*, 12*b*), respectively. In addition, valves (22*a*, 22*b*) are disposed also to the returning side of the recycling pipes (11*a*, 11*b***), respectively.

A circulation line is constituted by the paint reservoir (**10*a*) , the paint sucking pipe (21*a*) , the paint supply pump (8*a*), the paint supply pipe (7*a*) and the recycling pipe (11*a*), while the other circulation line is constituted by the paint reservoir (10*b*), the paint sucking pipe (21*b*), the paint supply pump (8*b*) , the paint supply pipe (7*b*) and the recycling pipe (11*b*). Preferably, air vent pipes (16*a*, 16*b*) which communicate with the manifold (5) are disposed to upper parts of the side plates (1, 2), and valves (17*a*, 17*b*) are disposed to the air vent pipes (16*a*, 16*b***), respectively.

A flow channel closing member (18) is disposed in the manifold (5) in a fluid sealing state as it is movable along the manifold (5), i.e., movable leftward and rightward. The flow channel closing member (18) shown in the drawings as an example is an ellipsoidal member having such a size as capable of fitting to the inside of the manifold (5) in a fluid sealing state and being contained in the side plates (1, 2). Then, as an example of a means for moving the flow channel closing member (18), drawing strings (**19*a*, 19*b*) are respectively connected to right end and left end of the flow channel closing member (18). Each of the drawing strings (19*a*, 19*b*) is taken out through each of side walls of the side plates (1, 2) to the outside and a take-out port for each of the drawing strings (19*a*, 19*b*) is sealed with each of packings (20*a*, 20*b***).

There is no particular restriction on the material of the flow channel closing member (18) so long as the material has a corrosion resistance against paint cleaning solvent, but it is preferably made of TEFLON. Further, a nylon thread is preferred for the drawing strings (**19*a*, 19*b***).

The flow channel closing member (18) may have a cylindrical shape.

The die coater of the present invention is used, for example, as described below.

Figure 4:
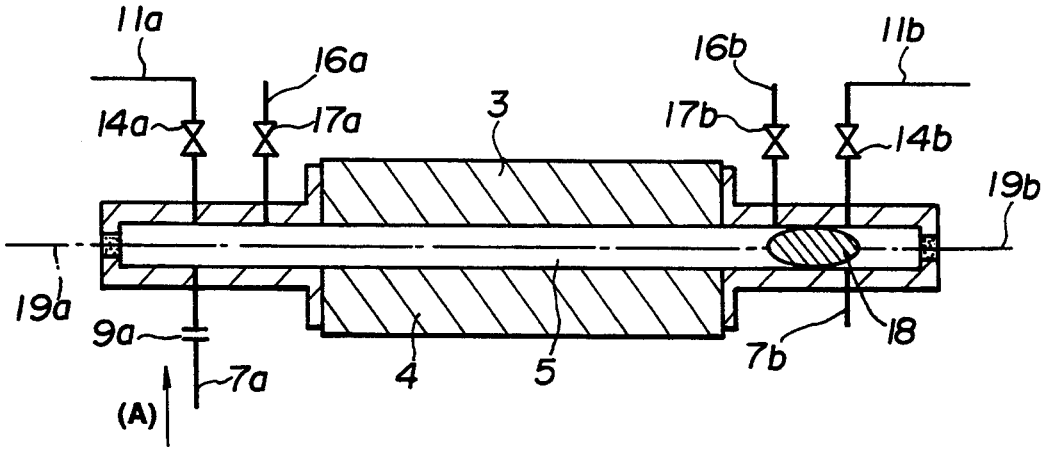
FIG. 4 is a schematical view of a state of the die coater in use.

1. Supply of Paint A (FIG. 4)

Paint A is supplied from the paint supply pipe (**7*a*) in a state where the flow channel closing member (18) is shifted to the rightmost end by an operation of the drawing string (19*b***).

The paint A is supplied by operating the paint supply pump (**8*a*), with the valves (14*a*, 14*b* and 17*a*, 17*b***) being kept closed.

Figure 5:
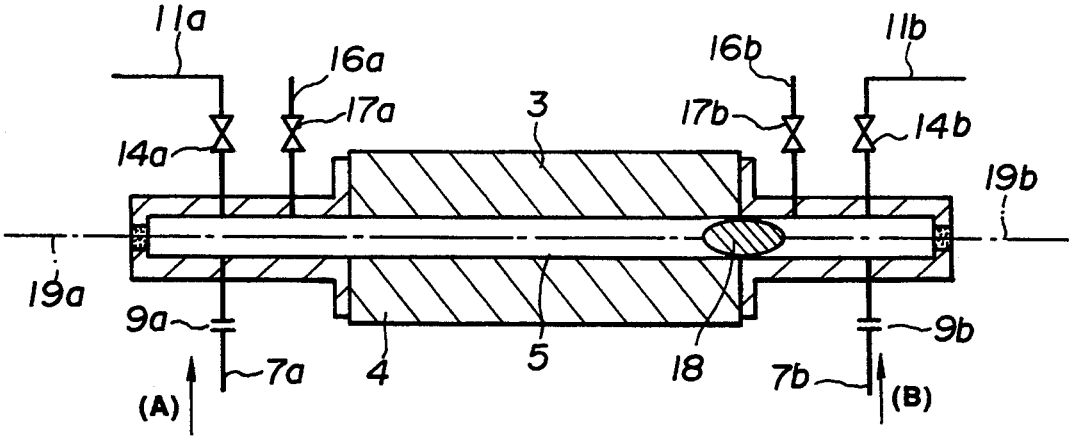
FIG. 5 is a schematical view of a state of the die coater in use.

2. Preparation for the Supply of Paint B (FIG. 5)

The paint supply pipe (7*b*) and the paint supply pump (8*b*) are connected by the joint (9*b*), the valve (14*b*) is opened and circulation of the paint B is started by operating the paint supply pump (8*b*). The paint B is circulated through the recycling pipe (11*b*) to the paint reservoir (10*b*) .

Figure 6:
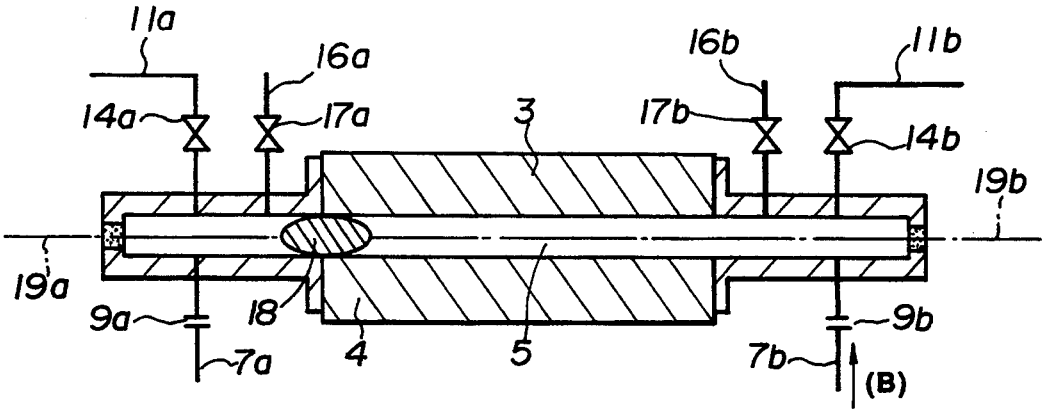
FIG. 6 is a schematical view of a state of the die coater in use.

3. Changing Operation to Paint B (FIG. 6)

The valve (14*a*) is opened and the valve (14*b*) is gradually closed and the drawing string (19*a*) is gradually drawn to shift the flow channel closing member (18) leftward. Further, the valves (17*a*, 17*b*) are gradually opened and then returned to the closed state.

By the operations as described above, the circulation amount of the paint B is decreased and the amount supplied to the manifold (5) is increased. Further, air vent is conducted in the paint B supplied in the manifold (5).

In the paint changing operation described above, as the flow channel closing member (18) is shifted gradually, pressure of the inside of the manifold is prevented from reducing to a negative pressure and, as a result, the paint A staying in the slit (6) can be substantially prevented from being sucked and mixed into the paint B.

Further, the paint A having stayed in the manifold (5) can be recovered easily through the recycling pipe (11*a*) to the paint reservoir (10*a*). In a case where the recycling pipe (11*a*) is not disposed, the paint is returned by way of the paint supply pipe (7*a*) and pump (8*a*) into the paint reservoir (10*a*).

The paint A having stayed in the slit (6) is extruded by the paint B now changed. Then, the extruded paint B can be recovered, for example, by a tray (not shown in the drawing) disposed ahead of the slit (6).

Figure 2:
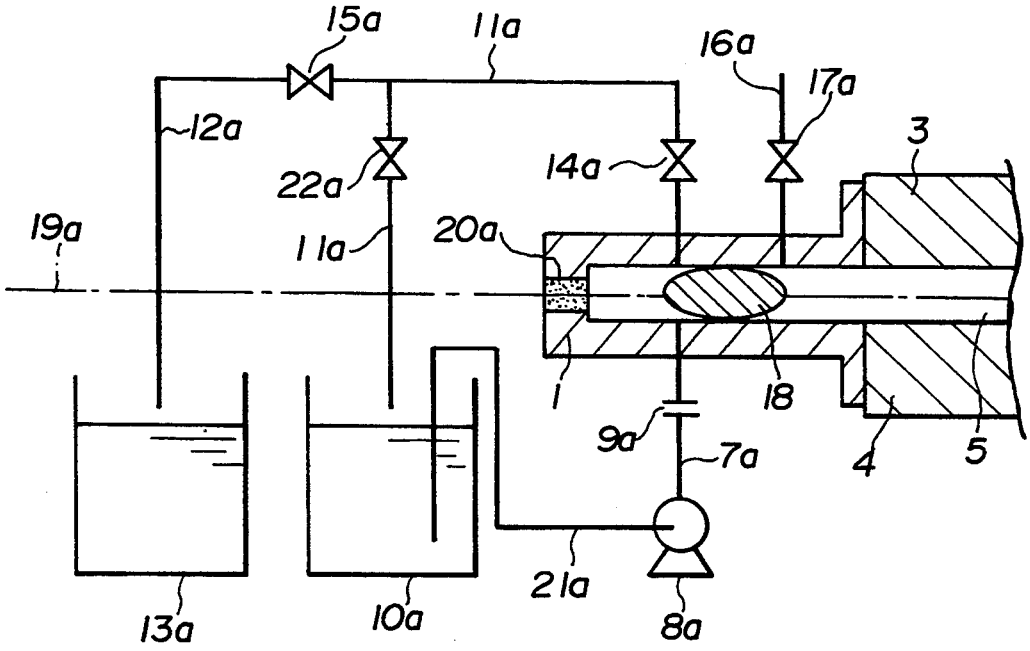
FIG. 2 is a schematical view of a portion of a die coater.
Figure 3:
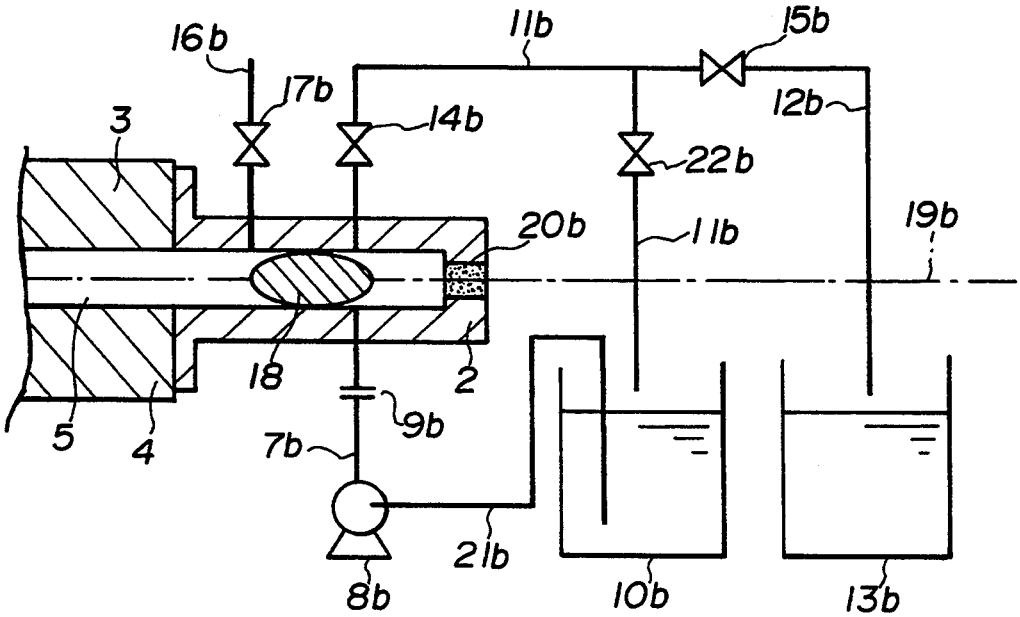
FIG. 3 is a schematical view of a portion of a die coater.

4. Cleaning Operation After Completion of Color Change to Paint B (FIG. 2)

Cleaning is conducted by opening the valve (15*a*) while closing the valve (22*a*) and by switching from the paint reservoir (10*a*) to a solvent reservoir (not shown in the drawing). Cleaning liquid wastes are recovered through the branched pipe (12*a*) into the liquid waste reservoir (13*a*).

According to the present invention described above, it can been provided an improved die coater capable of changing paints from one to another efficiently and easily without disassembling the die.

Therefore, the present invention is of a significant industrial value.

What is claimed is:

1. A die coater comprising a die composed of upper and lower die halves which form therebetween a manifold and a,slit extending from the manifold, a first paint supply pipe communicating with one end portion of the manifold, a second paint supply pipe communicating with an opposite end portion of the manifold and a flow channel closing member disposed in the manifold in a fluid sealing state, the member being movable along the manifold, means for selectively moving said closing member from one end portion to the opposite end portion thereby selectively shutting off fluid communication of one of said supply pipes to said manifold and slit while opening up fluid communication of the other supply pipe to said manifold and slit.

2. A die coater according to claim 1, further comprising side plates which are disposed to both side of the mold-pieces and form end portions of the manifold.

3. A die coater according to claim 2, further comprising a recycling pipe which Communicates with the manifold and is disposed to each of the side plates, a valve which is disposed to the recycling pipe, and a circulating line which is constituted by a paint supply pump, the paint supply pipe, the recycling pipe, a paint reservoir and a paint sucking pipe.

4. A die coater according to claim 3, further comprising a branched pipe which leads to a liquid waste reservoir and is disposed to each of the recycling pipes, and a valve which is disposed to the branched pipe.

5. A die coater according to claim 1, further comprising an air vent pipe which communicates with the manifold and is disposed to an upper part of each of the side plates, and a valve which is disposed to the air vent pipe.

6. A die coater according to claim 1, wherein the means for selectively moving the flow channel closing member includes strings connected to said closing member and extending through said end portions.

* * * * *

UNITED STATES PATENT AND TRADEMARK OFFICE

CERTIFICATE OF CORRECTION

PATENT NO. : 5,399,196

DATED : March 21, 1995

INVENTOR(S) : KUNIHIKO ICHIKAWA ET AL

It is certified that error appears in the above-indentified patent and that said Letters Patent is hereby corrected as shown below:

In the Drawings;

For drawing Figures 4, 5 and 6, element numerals 1 and 2 were omitted. See attached sheets for Figures 4, 5 and 6.

In column 4, line 8 (line 3 of Claim 1), change "a,slit" to --a slit--;

line 24 (line 2 of Claim 3), change "Communicates" to --communicates--;

line 41 (line 3 of Claim 6), before "strings" insert --drawing--.

Signed and Sealed this

Thirteenth Day of February, 1996

Bruce Lehman

*Attest:*

BRUCE LEHMAN

*Attesting Officer*

*Commissioner of Patents and Trademarks*